US005172537A

United States Patent [19]

Wetter et al.

[11] Patent Number: 5,172,537

[45] Date of Patent: Dec. 22, 1992

[54] BAG OPENING MEANS FOR BAGGING MACHINE

[76] Inventors: Bruno Wetter, 393 Moreau, St.-Eustache, Quebec, Canada, J7P 2M5; Arnold Lipes, 3493 Atwater Ave, Apt #18, Montreal, Quebec, Canada, H3H 1Y2

[21] Appl. No.: 722,455

[22] Filed: Jun. 27, 1991

[51] Int. Cl.[5] ..... B65B 43/44

[52] U.S. Cl. ..... 53/572; 53/173; 53/248; 53/384.1; 53/573

[58] Field of Search ..... 53/571, 572, 573, 170, 53/173, 247, 248, 67, 384.1, 385.1, 386.1

[56] References Cited

U.S. PATENT DOCUMENTS

| | | | |
|---|---|---|---|
| 2,156,561 | 5/1939 | Cordrey et al. | 53/173 |
| 3,209,515 | 10/1965 | Harpenau | 53/248 X |
| 3,430,409 | 3/1969 | Manfredonia et al. | 53/573 X |
| 3,731,454 | 5/1973 | Crabb | 53/55 |
| 3,789,573 | 2/1974 | Crabb | 53/573 X |
| 3,822,527 | 7/1974 | Germunson et al. | 53/572 |
| 3,864,894 | 2/1975 | Sheetz et al. . | |
| 3,946,538 | 3/1976 | Lipes . | |
| 4,172,349 | 10/1979 | Lipes | 53/459 |
| 4,177,621 | 12/1979 | Powell, Jr. | 53/572 X |
| 4,215,520 | 8/1980 | Heinzer et al. | 53/173 |
| 4,253,292 | 3/1981 | Lipes | 53/506 X |
| 4,291,517 | 9/1981 | Lipes | 53/468 |
| 4,715,167 | 12/1987 | Savigny | 53/573 X |
| 4,938,003 | 7/1990 | Seppala | 53/247 X |

FOREIGN PATENT DOCUMENTS

| | | | |
|---|---|---|---|
| 1144135 | 4/1983 | Canada . | |
| 1260884 | 9/1989 | Canada . | |
| 2131126 | 1/1973 | Fed. Rep. of Germany | 53/573 |

*Primary Examiner*—John Sipos
*Assistant Examiner*—Daniel B. Moon

[57] ABSTRACT

A bagging machine having means for holding a plurality of unopened bags wherein the bags have an extended tab, means for manipulating the extended tab, thereby opening the bag and allowing it to be filled, and clamping means for manipulating the mouth of the bag before, during and after filling.

2 Claims, 3 Drawing Sheets

BAG OPENING MEANS FOR BAGGING MACHINE

FIELD OF THE INVENTION

The present invention relates to an automatic bagging machine and the method of operation thereof, and more particularly to a machine capable of bagging material by placing the material in an open mouth of a first bag of a plurality of bags, and releasing the first bag.

DESCRIPTION OF THE RELATED ART

Bagging machines for holding, transporting, filling and sealing plastic bags are well known in the art. An example of such a machine is disclosed in U.S. Pat. No. 4 253 292 to Arnold Lipes, which issued Sep. 29, 1981. Although such machines have been used successfully for packaging materials such as pluralities of carrots, difficulties are experienced when packaging materials in wide bags, e.g. 60 cm wide. It is a feature of this invention to address, these difficulties.

SUMMARY OF THE INVENTION

Accordingly the present invention provides a bagging machine for placing a plurality of objects in a first bag of a plurality of juxtaposed, wide bags held in said machine, said bags having a front wall portion and a back wall portion, and having an extended tab secured to the back wall portion thereof, said tab extending above a mouth opening of said bag, said machine comprising:

a) first holding means for holding said plurality of bags in juxtaposition, said bags being held by said tabs;

b) second holding means for transversely securing at least a portion of said extended tab of said first bag;

c) bag opening means for opening said mouth of said first bag comprising i) third holding means to hold the front portion of the bag, at the mouth, such that a smaller mouth is formed by the third holding means, ii) mouth opening means adapted to separate the front wall portion of the bag, at the smaller mouth, from the back wall portion, and iii) means to displace the third holding means, such that a full mouth of the bag is formed;

d) mouth clamping means associated with the mouth opening means, for holding the full bag mouth in an open position; and e) sensing and correction means adapted to sense whether the bag has been clamped by the mouth clamping means and if not, to cause the bag opening and bag clamping means to attempt bag opening and clamping again.

In another embodiment the bag opening means has an air jet adapted to initially open part of the smaller bag mouth.

In yet another embodiment the air jet means comprises an air jet located to blow gas into the center of the mouth of the first bag.

In yet another embodiment the machine is adapted to open mouths of bags whose total width is from about 50 cm to 90 cm.

As will be understood, when the smaller mouth is about half the width of the full bag mouth the bag mouth will form an approximately square opening when the bag mouth is fully opened. The most advantageously sized smaller mouth can be determined by simple experimentation and often is from 40 to 60% of the full bag opening.

In a further embodiment the machine additionally has case positioning means for placing and holding an open-mouthed case such that the opened full bag mouth is above the mouth of the case.

In one embodiment there is a bar level with or above the case mouth opening, between the case and the bag, said bar being adapted to permit the bag to slide thereover.

In another embodiment the mouth opening means comprises a vacuum tube adapted to temporarily secure the front wall to the vacuum tube across the extent of the small mouth.

In yet another embodiment the machine is adapted to open mouths of bags from 50 cm to 90 cm wide.

The invention also provides a process for filling a bag with a plurality of objects, on a bagging machine which is adapted to place said objects in a first bag of a plurality of juxtaposed, wide bags held in said machine, said bags having a front wall portion and a back wall portion, and having an extended tab secured to the back portion thereof, said tab extending above a mouth opening of said bag, said process comprising:

a) holding at least a portion of said extended tab of said first bag;

b) holding the bag at the mouth such that a smaller mouth opening is formed thereby;

c) opening the smaller mouth of the first bag by securing the extremities of the smaller mouth and pulling the mouth opening means away from the extended tab;

d) holding the full mouth in an open position; and e) dropping objects into said bag mouth.

In one embodiment the smaller bag mouth is opened by blowing a jet of gas into the smaller mouth of the bag sufficient to allow a small mouth securing and opening means to enter the mouth.

In another embodiment the small mouth securing and opening means are clamps at the extremities of the small mouth.

In a further embodiment the small mouth is delineated by two holding means which are adapted to rest against the front wall adjacent the mouth.

In yet a further embodiment a sensor senses whether the front wall of the first bag has been engaged by the mouth opening means and causes step c) to be reiterated until the mouth opening means has entered the mouth of the bag and engaged the mouth.

In yet another embodiment the bags are from about 50 cm to 90 cm wide.

In another embodiment the bags are made of plastic film.

In a further embodiment the plastic film is a polyethylene having a thickness of from about 20 to about 50 micrometres.

In another embodiment the bag is made from netting.

In a further embodiment an open-mouthed case is positioned such that the opened full bag mouth is above the mouth of the case; objects are dropped into said bag mouth, causing the front bag wall to be pulled into the case; and when the desired number of objects are in the bag, the bag mouth is released.

In one embodiment there is a bar which is about level with or above the case mouth opening and between the case and the bag, and which permits the bag to slide thereover, thus permitting the objects to pull the bag into the case.

In yet another embodiment the bar is a roller.

The invention further provides a process for filling a bag with a plurality of objects and for placing the bag in a case, said bags having a front wall portion and a back wall portion, said process comprising:

a) holding the unopened bag such that the bag hangs down at the side of the case and such that the mouth of the bag is above a plane which passes through the mouth of the case;

b) opening the mouth of the bag such that the mouth of the bag is situated above the case and the front wall of the bag extends from the mouth, over an upper edge of the case, to the bottom of the bag which is situated at the side of the case; and c) dropping said objects into the bag through the open mouth positioning onto the inner surface of the front wall, causing the front bag wall to be pulled into the case.

A further aspect of the invention provides an apparatus for sealing the mouth of a filled bag, which apparatus comprises a) means to initially hold the bag mouth open, b) two bars which are adapted to cooperate and gather the bag therebetween, just below the bag mouth, and c) means to release the hold on the bag mouth simultaneously with the gathering of the bag, and d) means to squeeze the gathered portion of the bag together in a direction perpendicular to the length of the cooperating bars when the bag has been gathered and to seal the so gathered and squeezed bag.

In one embodiment both bars are pivoted such that they are adapted to swing together in order to sweep the bag material ahead of each bar and so gather the bag.

In another embodiment one of the bars is adapted to swing into position, sweeping the bag material ahead of it and the other bar is adapted to move in a direction perpendicular to the bar in order to sweep bag material towards the position where the bag material is to be gathered.

In a further embodiment the means to squeeze the gathered portion is a thermal heat sealer, which is also adapted to heat seal the squeezed and gathered portion.

In another embodiment the means to squeeze the gathered portion is a clipping device, which is also adapted to clip the squeezed and gathered portion.

BRIEF DESCRIPTION OF THE DRAWINGS

Preferred embodiments of the invention will now be described with reference to the accompanying drawings in which.

DESCRIPTION OF THE PREFERRED EMBODIMENTS

Figure 1:
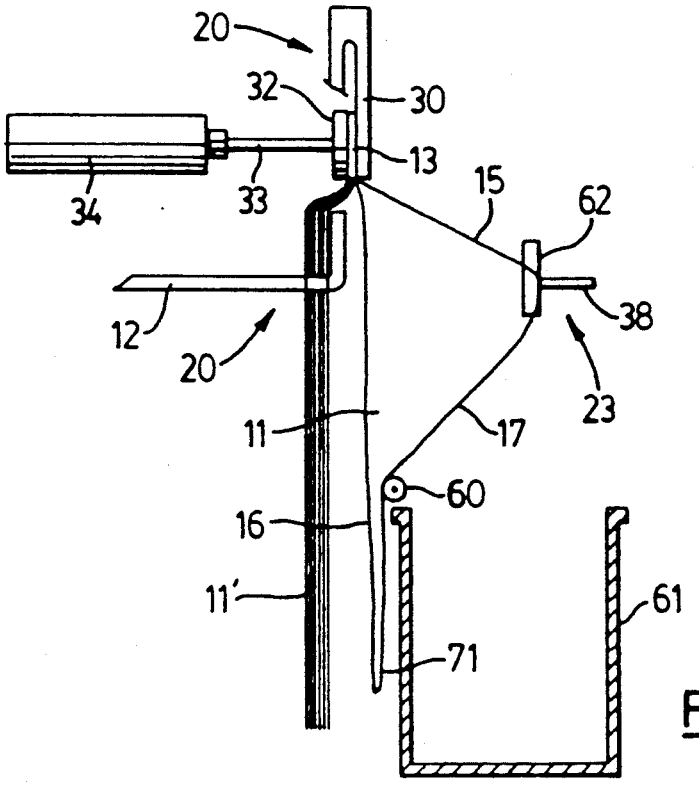
FIG. 1 is a schematic view illustrating operation of the bagging machine during opening of a bag.
Figure 2:
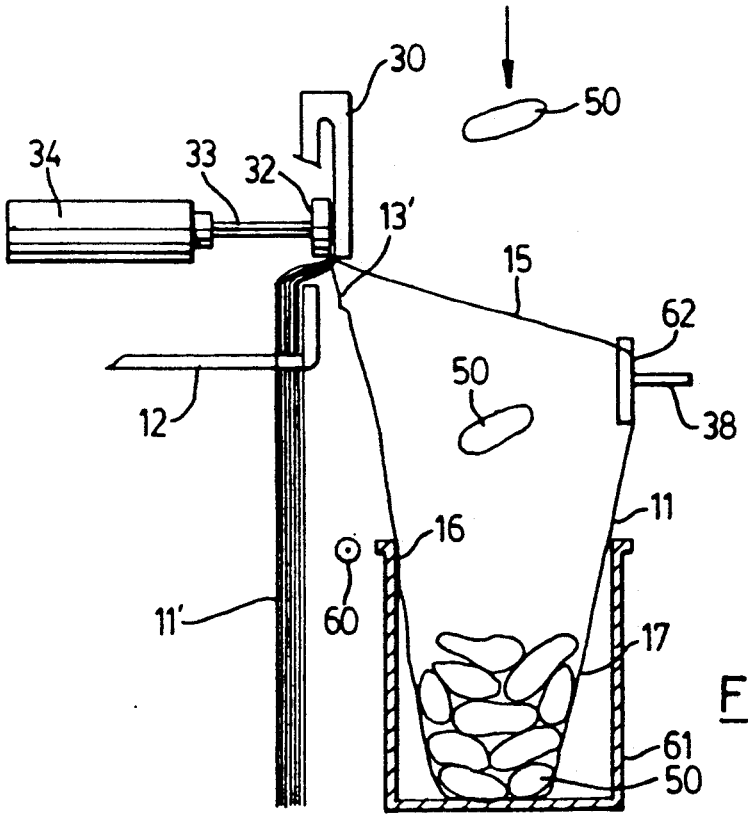
FIG. 2 is a further schematic view illustrating a step in the operation of the bagging machine where pouches are dropped into the bag.
Figure 3:
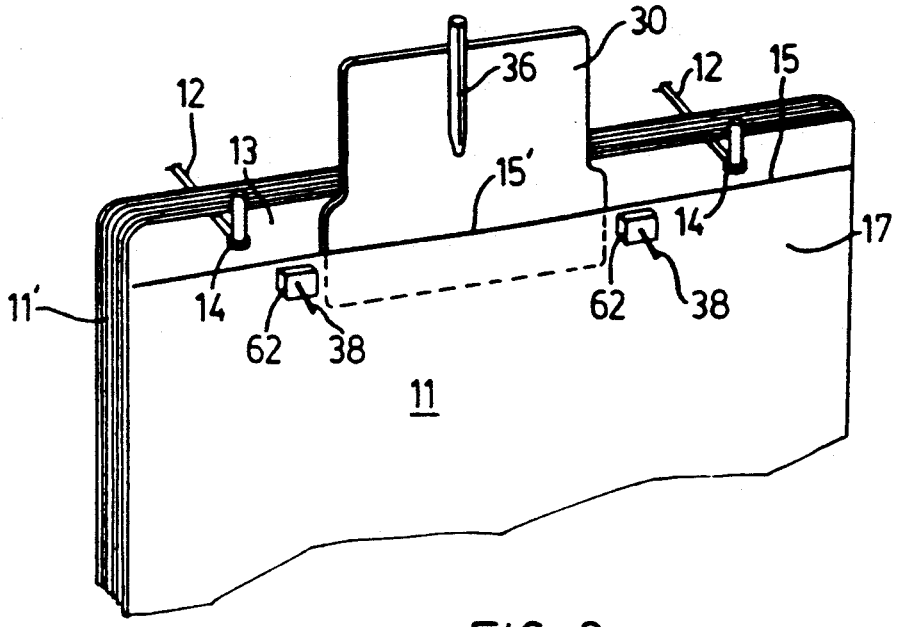
FIG. 3 is a perspective view, partly fragmented, illustrating a position for blocking a bag prior to opening the bag mouth.
Figure 4:
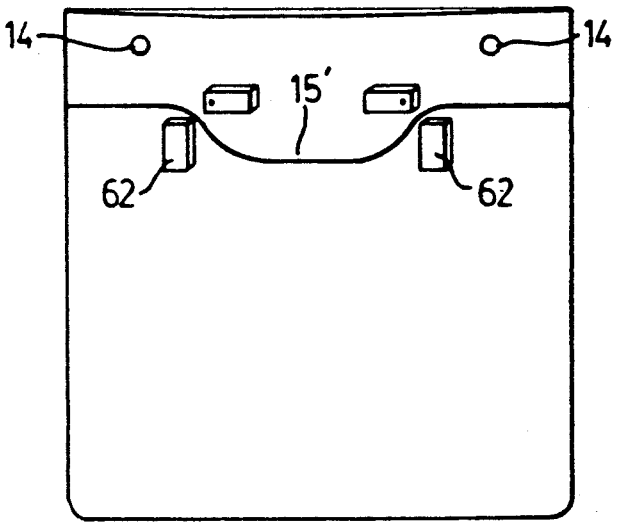
FIG. 4 is a front view of the bag as the smaller mouth is being opened.

Referring to the drawings, particularly FIGS. 1 to 4, there are shown the essential parts of the automatic bagging machine for holding and opening a first bag 11 of a plurality of bags 11' held in the machine by wicket pins 12. Each of the bags 11 has an extended tab 13 or 13' provided with two spaced apart apertures 14. Apertures 14 allow bags to be slidingly retained on the wicket pins 12. Each bag is also provided with a mouth 15, defined between rear bag wall 16 and front bag wall 17 see FIGS. 2 and 4). Although not shown in the drawings the bags may have bottom gussets therein at the portions where the front and back walls adjoin.

The machine includes holding means 20 for engaging at least a portion of the extended tab 13 of the first bag 11. A displaceable clamp 32 is secured to the free end of a piston rod 33 of piston 34. The clamping surface of the displaceable clamp 32 is positioned in alignment with the clamping surface of the stationary clamp 30 whereby all of the extended tabs 13 are held compressed between the clamping surfaces when the piston rod 33 is displaced outwardly from the piston cylinder 34.

The bag opening means 23 comprises two pressure pads 62 and corresponding bag clamps 63, an air jet 36 and retractor members 38. Pressure pads 62 are spaced apart and bear upon the mouth 15 of bag 11, at a position just wider than stationary clamp 30, thus lightly holding the mouth portion of front bag wall 17. For a bag having a 61 cm layflat width and a film thickness of about 25 μm, typically the distance between pressure pads 62 would be from about 25 cm to 40 cm. The portion of the front bag wall between pressure pads 62 forms a smaller bag mouth 15'. Air jet 36 is positioned above and adjacent the smaller mouth opening 15' of the bag in order to direct a jet of air into the smaller mouth opening after the bag mouth is engaged by pressure pads 62. Blowing air through jet 36 causes the smaller mouth 15' of the bag to open and to permit the insertion of bag clamps 63 to be swung inside smaller mouth 15' and to clamp the film of the mouth between pressure pads 62 and bag clamps 63.

Figure 5A:
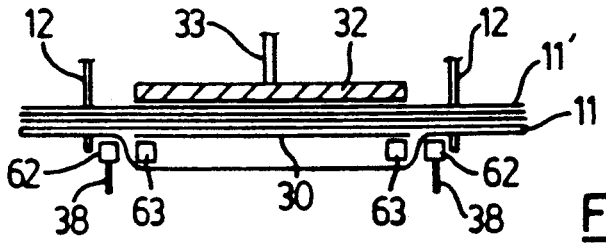
FIGS. 5*a* and 5*b* are plan views showing steps in opening the bag mouth.

Pressure pads 62 and bag clamps 63 are on the same frame (not shown) so that movement of retractor members 38 causes pressure pads 62 and the corresponding bag clamps 63 to move together in the direction of travel of retractor members 38. This arrangement is shown in FIG. 5*a*.

Figure 5B:
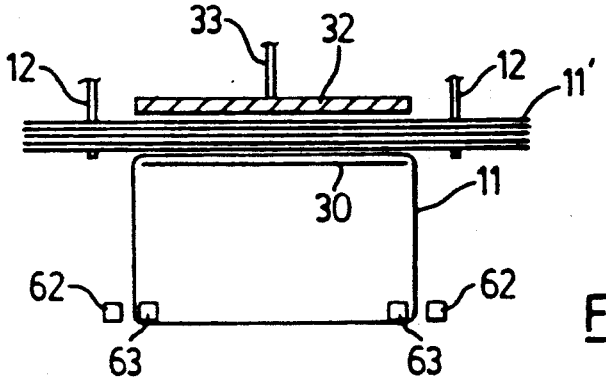

As retractor members 38 are moved away from stationary clamp 30, the front wall 17 is pulled away from the back wall 16. Extended tab 13, which continues to be held by stationary clamp 30 and displaceable clamp 32, is ripped away from wicket pins 12. As shown in FIG. 5*b*, pressure pads 62 and corresponding bag clamps 63 are moved to their furthest travel position so the mouth of the bag consists of the full mouth 15, which is opened fully above case 61.

As will be seen in FIG. 1, as retractor members 38 are moved away from stationary clamp 30, front wall 17 is pulled over roller 60. It is not essential that roller 60 be present because the front wall 17 would be pulled over the upper lip of case 61. However, in practice the cases are reused and tend to become damaged, particularly at the lip, causing there to be snags on the lip. Such snags may damage the front wall 17 as it is pulled over the lip, so roller 60, a bar or similar is preferred. As indicated hereinabove, extended tab 13 is pulled off wicket pins 12. To facilitate disconnection, a razor edge may be provided along the top of the pins 12. Disconnection can also be aided by the weight of the product 50 being dropped into the bag. In the case of packaging pouches, it is usual to drop pouches 50 into bag 11 one at a time until a defined number of pouches are in the bag.

Instead of pressure pads 62 and air jet 36, a tube which extends the width of smaller mouth 15' may be used. The tube has holes in it adjacent the film of the bag which permit vacuum to secure film thereto. Thus, the vacuum tube is used to pull smaller mouth 15' away from the back wall 16 of bag 11. The vacuum tube still has fingers 63 attached thereto for gripping the film more positively. For a bag having a 61 cm layflat width and a film thickness of about 25 μm, typically the length of the tube would be from about 25 cm to 40 cm.

Figure 6:
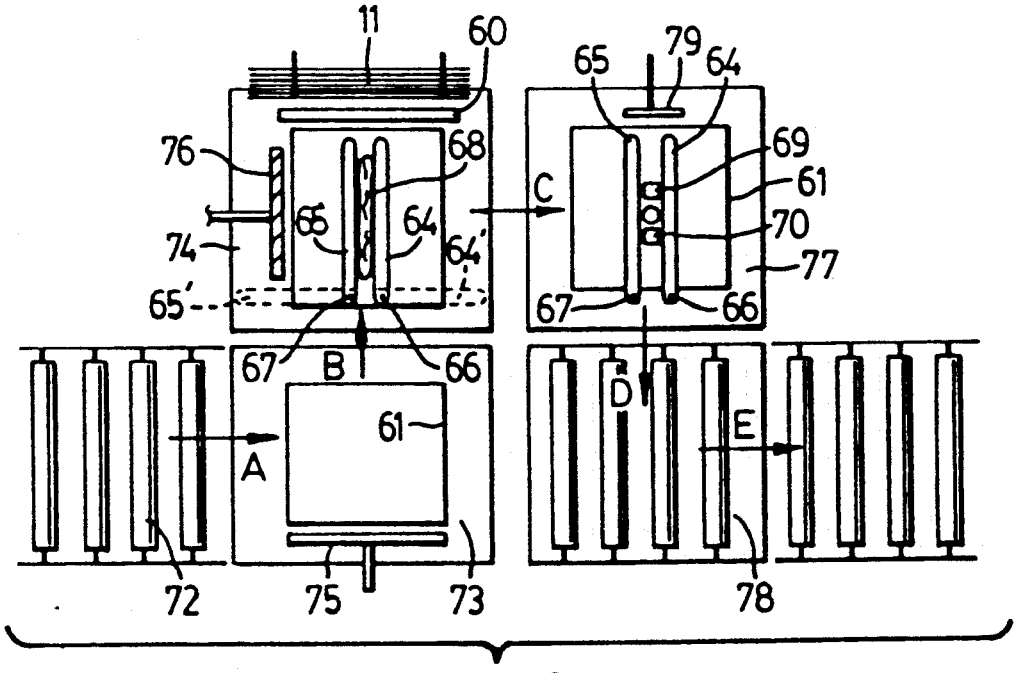
FIG. 6 is a plan view of a bagging machine showing the stages of travel of a case and of closing the mouth of a bag.

Having given the sequence for opening the bag mouth, a description of the whole process of placing the bag in a case will now be given. Prior to opening the bag, a case or box 61 is placed in position adjacent to bag 11 in readiness for bag mouth 15 to be opened thereabove. As shown in FIG. 6 cases are brought to the bagging machine along a conveyor 72, in a direction shown by arrow A, and onto platform 73. Once in position on platform 73, case 61 is pushed, in a direction shown by arrow B, onto platform 74 by ram 75.

The bag opening sequence described hereinabove takes place. If there is no film grasped between pressure pads 62 and bag clamps 63, however, control circuitry is activated which causes air to continue to issue from air jet 36 and the bag clamps 63 to open and reattempt grasping the film again. In this way it is not possible to drop product, e.g. pouches, into bag 11 until the mouth of bag 11 is firmly held and open. Control of the working parts of the apparatus may be provided pneumatically, e.g. air with suitable valves, and with a microprocessor.

It has been found that for productivity reasons, it is desirable to continue to keep control of the mouth of the bag, rather than allow it to be free, while the filled bag seats itself in case 11 and while the mouth of the bag is gathered and sealed. Thus, after the bag 11 has been filled with objects, e.g. pouches 50, the mouth is gathered by arms 64 and 65 which are pivoted on pivots 66 and 67 respectively, as shown in FIG. 6. Arms 64 and 65 start in positions 64' and 65' respectively. The arms are then caused to swing towards one another about pivots 66 and 67. As arms 64 and 65 close together, the mouth 15 of bag 11 is gathered therebetween, as shown at 68. As arms 64 and 65 close on the mouth of bag 11, bag 11 is released from being held by clamp devices 30 and 32 by momentarily withdrawing piston 33, and by opening bag clamps 63, and allowing the weight of the filled bag to drop the bag to rest in case 61.

Case 61 and arms 64 and 65 are on a carriage (not shown). This carriage is pushed in the direction of arrow C by ram 76 until the carriage is over platform 77. The gathered mouth 68 is then squeezed along the length of and between arms 64 and 65 by two sealing heads 69 and 70, for example the sealer described in Canadian Patent No. 1 260 884 which issued Sep. 26, 1989 to A. Lipes and G. Soga. After the mouth 15 has thus been sealed or otherwise secured, e.g with a clip, case 61 is pushed in direction D by ram 79 onto conveyor 78. While the case travels along conveyor 78 in direction E, the carriage, which is over platform 77 is returned to position over platform 74 in readiness for filling another bag and case.

The apparatus described herein is particularly useful for bags made of plastic films such as polyethylene. Other adaptations, within the skill of one skilled in the art, may be made for bags of paper, netting or the like. Obviously, when the bag is made of netting the mouth would not be openable with a vacuum system and this is clear to those skilled in the art.

The present invention may be use to bag a number of products, e.g. carrots, milk pouches. For example the apparatus may be used to package fifty 280 ml pouches containing milk.

We claim:

1. A bagging machine for placing a plurality of objects in a first thin walled bag of a plurality of juxtaposed, wide bags held in said machine, and said first bag into a case having a mouth opening in front of said first bag, each of said bags having a front wall portion and a back wall portion, said front wall portion having two upper corners and a middle portion therebetween, and each of said bags having an extended tab secured to the back wall portion thereof, said tab extending above a mouth opening of each of said bags, said machine comprising:

a) first holding means for holding said plurality of bags in juxtaposition, said bags being held by said tabs;

b) second holding means for securing at least a portion of said extended tab of said first bag;

c) bag opening means for opening said mouth of said first bag comprising i) third holding means which comprises two spaced apart implements to hold the middle front wall portion of the bag, at the mouth, such that a smaller mouth is formed between the two spaced apart implements, and the spaced apart implements ar at a distance from one another of about 40% to about 60% of the distance between the two upper corners of the front wall portion, ii) mouth opening means adapted to separate the front wall portion of the bag from the back wall portion between the two implements, and iii) means to displace the third holding means, such that a full mouth of the bag is formed and supported in a square or rectangular configuration; and d) mouth clamping means associated with the third holding means for insertion into said smaller mouth, and means for displacing the mouth clamping means along with the third holding means for holding the bag mouth in an open position;

e) a bar member being about level with or above said case for maintaining the bag in a position behind the case during a first portion of the filling process and for allowing the bag to flop over the bar and into the case during a second portion of the filling process, said case thereby providing support to the bag during and after filling.

2. A machine according to claim 1 which additionally has case positioning means for placing and holding an open-mouthed case such that the opened full bag mouth is above the mouth of the case.

* * * * *